US008992249B2

(12) United States Patent
Kobayashi et al.

(10) Patent No.: US 8,992,249 B2
(45) Date of Patent: Mar. 31, 2015

(54) SHIELDED CONNECTOR

(71) Applicant: Yazaki Corporation, Tokyo (JP)

(72) Inventors: Masaki Kobayashi, Makinohara (JP); Norio Sugiyama, Makinohara (JP)

(73) Assignee: Yazaki Corporation, Tokyo (JP)

( * ) Notice: Subject to any disclaimer, the term of this patent is extended or adjusted under 35 U.S.C. 154(b) by 33 days.

(21) Appl. No.: 14/039,865

(22) Filed: Sep. 27, 2013

(65) Prior Publication Data

US 2014/0030921 A1 Jan. 30, 2014

Related U.S. Application Data

(63) Continuation of application No. PCT/JP2012/058012, filed on Mar. 27, 2012.

(30) Foreign Application Priority Data

Mar. 31, 2011 (JP) ..... 2011-079572

(51) Int. Cl.
*H01R 13/6581* (2011.01)
*H01R 13/6591* (2011.01)
*H01R 13/74* (2006.01)

(52) U.S. Cl.
CPC ..... *H01R 13/6581* (2013.01); *H01R 13/6591* (2013.01); *H01R 13/748* (2013.01); *H01R 2201/26* (2013.01)
USPC ..... 439/548; 439/564; 439/362; 439/607.28

(58) Field of Classification Search
USPC ..... 439/607.28–607.3, 548, 271, 556, 564, 439/573, 362
See application file for complete search history.

(56) References Cited

U.S. PATENT DOCUMENTS

| | | | | | |
|---|---|---|---|---|---|
| 3,187,292 | A | * | 6/1965 | Small et al. | 439/275 |
| 4,588,247 | A | * | 5/1986 | Grappe et al. | 439/271 |
| 4,767,351 | A | * | 8/1988 | Patel et al. | 439/363 |
| 5,066,246 | A | * | 11/1991 | Jensik | 439/562 |
| 5,092,791 | A | * | 3/1992 | Contarino | 439/365 |
| 5,288,244 | A | * | 2/1994 | Lien | 439/362 |
| 5,306,175 | A | * | 4/1994 | Swanstrom | 439/362 |
| 5,782,645 | A | * | 7/1998 | Stobie et al. | 439/289 |

(Continued)

FOREIGN PATENT DOCUMENTS

| | | | |
|---|---|---|---|
| EP | 2369690 | A1 | 9/2011 |
| JP | 2002373737 | A | 12/2002 |

(Continued)

OTHER PUBLICATIONS

International Search Report, dated Jun. 26, 2012, issued by the International Searching Authority in counterpart International Application No. PCT/JP2012/058012.

(Continued)

*Primary Examiner* — Gary Paumen
(74) *Attorney, Agent, or Firm* — Sughrue Mion, PLLC

(57) ABSTRACT

A shielded connector includes device-side connector which is fixed to a shield case and a cable-side connector which is attached to an end of an external cable and is fitted to the device-side connector. The device-side connector includes a device-side connection terminal, a device-side resin housing, and a device-side shield shell. The device-side shield shell includes a mating shell fixing part which electrically connects the device-side shield shell and a cable-side shield shell.

2 Claims, 8 Drawing Sheets

(56) References Cited

U.S. PATENT DOCUMENTS

| | | | | |
|---|---|---|---|---|
| 5,833,494 | A * | 11/1998 | Diaz | 439/573 |
| 6,305,975 | B1 * | 10/2001 | Steiner | 439/559 |
| 6,343,957 | B1 * | 2/2002 | Kuo et al. | 439/638 |
| 7,329,145 | B2 * | 2/2008 | Yagome et al. | 439/556 |
| 8,231,399 | B2 * | 7/2012 | Daubigney | 439/316 |
| 2004/0266265 | A1 | 12/2004 | Hayashi | |
| 2010/0261365 | A1 | 10/2010 | Sakakura | |
| 2011/0235977 | A1 | 9/2011 | Yamada | |

FOREIGN PATENT DOCUMENTS

| | | | |
|---|---|---|---|
| JP | 200511647 | A | 1/2005 |
| JP | 2005327557 | A | 11/2005 |
| JP | 2008-235189 | A | 10/2008 |
| JP | 2010-211935 | A | 9/2010 |

OTHER PUBLICATIONS

Written Opinion, dated Jun. 26, 2012, issued by the International Searching Authority in counterpart International Application No. PCT/JP2012/058012.

Search Report dated Jul. 15, 2014, issued by the European Patent Office in counterpart European Application No. 12764081.1.

International Preliminary Report on Patentability dated Oct. 17, 2013, issued by the International Searching Authority in counterpart Application No. PCT/JP2012/058012.

Office Action dated Jan. 6, 2014 issued by Japanese Patent Office in counterpart Japanese Patent Application No. 2011-079572.

* cited by examiner

SHIELDED CONNECTOR

CROSS REFERENCE TO RELATED APPLICATIONS

This application is a continuation of PCT application No. PCT/JP2012/058012, which was filed on Mar. 27, 2012 based on Japanese Patent Application (No. P2011-079572) filed on Mar. 31, 2011, the contents of which are incorporated herein by reference.

BACKGROUND OF THE INVENTION

1. Field of the Invention

The present invention relates to a shielded connector which connects an external cable to a circuit in a shield case of a device.

2. Description of the Related Art

FIG. 8 shows the shielded connector of a prior example. A shielded connector 100 is disclosed in JP-A-2002-373737.

The shielded connector 100 is a connector by which external cables 110 are connected to a circuit in a shield case 103 of a device carried in an automobile or the like.

The shielded connector 100 includes cable-side connection terminals 120 which are crimped and connected to the distal ends of the external cables 110, a resin housing 130 which accommodates and holds the cable-side connection terminals 120, a shield shell 140 which holds the resin housing 130 and is fixed to the shield case 103 by screw members, and a packing 150 which seals a space between the shielded connector 100 and the shield case 103.

The cable-side connection terminal 120, as shown in FIG. 8, includes a tongue-shaped terminal part 121 at one end and includes an electric wire crimping part 122 at the other end. The tongue-shaped terminal part 121, as shown in FIG. 8, is a part which is connected to a tongue-shaped terminal 104 of the circuit in the shield case 103 by the screw members 105, 106. The electric wire crimping part 122 is a part which is crimped and connected to an end of the external cable 110.

The resin housing 130 is molded, and is integrally formed to accommodate the cable-side connection terminals 120. The external shape of the resin housing 130 is columnar so that the resin housing 130 can be inserted into a connector insertion hole 107 which penetrates the shield case 103. A packing installing groove 131 into which the packing 150 is installed is formed at the periphery of the resin housing 130 as a circle around the periphery.

The shield shell 140 includes a pipe-like shell body 141 which holds a base end 130*a* of the resin housing 130 which accommodates the ends of the external cables 110, and a case-fixing flange part 142 which is provided to be extended to be flange-shaped from the end of the shell body 141 at the side of the shield case 103. The case-fixing flange part 142 abuts against the outer surface of the shield case 103 in a face contact state, and is screw-fixed to the shield case 103 by a bolt 108. When the case-fixing flange part 142 is screw-fixed to the shield case 103, the shielded connector 100 is fixed to the shield case 103.

The packing 150 is a ring-shaped packing which is installed into the packing installing groove 131 of the resin housing 130. The packing 150 blocks the gap between the inner peripheral surface of the connector insertion hole 107 and the outer peripheral surface of the resin housing 130, and thus seals the space between the shielded connector 100 and the shield case 103.

However, since the shielded connector 100 disclosed in JP-A-2002-373737 is so constructed that the ring-shaped packing 150 is equipped on the outer peripheral surface of the resin housing 130 which is inserted into the connector insertion hole 107, and the ring-shaped packing 150 is closely contacted with the inner peripheral surface of the connector insertion hole 107 to seal the space between the shielded connector 100 and the shield case 103, if the external cables 110 are attached to and detached from the shield case 103 repeatedly, the packing 150 is easy to be damaged due to the sliding movement of the resin housing 130 in the connector insertion hole 107, and the sealing performance of the part attached to the shield case 103 may be decreased.

If the dimension of the attached part of the shield case 103, such as the arrangement of screw holes 109 in the shield case 103 to which the bolt 108 is screwed, or the shape or the dimension of the connector insertion hole 107, is changed, in response to the change, not only the design of the shield shell 140 but also the design of the resin housing 130 and the packing 150 which are both closely fitted with the connector insertion hole 107 need to be changed. That is, when the dimension of the attached part of the shield case 103 is changed, the designs of a large number of the components need to be changed. Therefore, there is a problem that much labor is necessary for product development in response to the change of the dimension of the attached part of the shield case.

SUMMARY OF THE INVENTION

Thus, an object of the present invention is to solve the above problems and provide a shielded connector so that even if the external cables are attached to and detached from the shield case repeatedly, the sealing performance of the part attached to the shield case will not be decreased, and product development in response to the change of the dimension of the attached part of the shield case can be easily performed.

The above-mentioned object of the invention is achieved by the following constructions.

(1) There is provided a shielded connector which connects an external cable to a circuit in a shield case of a device, the shielded connector comprising:

a device-side connector which is fixed to the shield case; and a cable-side connector which is attached to an end of the external cable and is fitted to the device-side connector, wherein the device-side connector includes:

a device-side connection terminal which has one end connected to the circuit in the shield case and the other end fitted to a connection terminal of the cable-side connector;

a device-side resin housing which accommodates and holds the device-side connection terminal and can be fitted to the cable-side connector;

a device-side shield shell which holds the device-side resin housing and has a case-fixing flange part which is fixed to an outer surface of the shield case by a screw in a face contact state; and a first packing which is pressed onto the outer surface of the shield case when the case-fixing flange part is fixed to the shield case by the screw to seal a space between device-side connector and the shield case;

wherein the device-side shield shell has a mating shell fixing part which is fastened to a cable-side shield shell provided on the cable-side connector to electrically connect the device-side shield shell and the cable-side shield shell; and wherein the mating shell fixing part is fastened to the cable-side shield shell by a second screw in a direction being the same as an extending direction of the first screw which fastens the case-fixing flange part to the shield case.

(2) The shielded connector according to the above (1), wherein the device-side shield shell has a thick part which is formed in thick shape so as to protrude to an outer side of the shield case beyond the projecting height of the first screw, which fastens the case-fixing flange parts to the shield case, and functions as a hood part to accommodate a fitting part of the cable-side connector; and wherein the mating shell fixing part is provided on the thick part.

According to the construction of the above (1), the shielded connector includes a device-side connector which is fixed to the shield case, and a cable-side connector which is attached to the end of the external cable and is fitted to the device-side connector. Therefore, attaching and detaching the external cable to/from the shield case are realized by attaching and detaching the cable-side connector to/from the device-side connector.

In other words, when the external cable is attached to or detached from the shield case, the device-side connector may be maintained to be fixed to the shield case, and even if the external cable is attached to and detached from the shield case repeatedly, the first packing which seals the space between the device-side connector and the shield case will no be influenced at all.

Therefore, the sealing performance of the part attached to the shield case will not decrease even if the external cables are attached to and detached from the shield case repeatedly.

Besides, since the space between the shield case and the device-side connector is sealed by the first packing which is clamped between the case-fixing flange part of the shield shell and the outer surface of the shield case, the device-side resin housing can be loosely fitted in the connector insertion hole at the shield case, and the dimension precision of the external shape of the device-side resin housing will not influence the sealing performance of the part attached to the shield case.

Therefore, if the dimension of the attached part of the shield case is changed, in response to the change, only the design of the shield shell which is attached to the shield case needs to be changed, but the dimension of the part of the device-side resin housing that is coupled with the shield shell can be maintained as before.

Therefore, when the dimension of the attached part of the shield case side is changed, in response to the change, the designs of the components only need to be changed slightly, so that product development in response to the change of the dimension of the attached part of the shield case can be easily performed.

According to the construction of the above (2), since the thick part provided on the shield shell also serves as the hood part which accommodates the distal end of the cable-side connector, it is not necessary to form a hood part, which accommodates the distal end of the cable-side connector, at the device-side resin housing, so that the construction of the device-side resin housing can be simplified.

Furthermore, since the mating shell fixing part is equipped at the thick part, an enough length is ensured for the screw hole as the mating shell fixing part, and the connecting strength in screw-connecting can be improved.

DETAILED DESCRIPTION OF THE EXEMPLARY EMBODIMENTS

Preferred embodiments of the shielded connector according to the present invention are described in detail with reference to the figures as follows.

Figure 1:
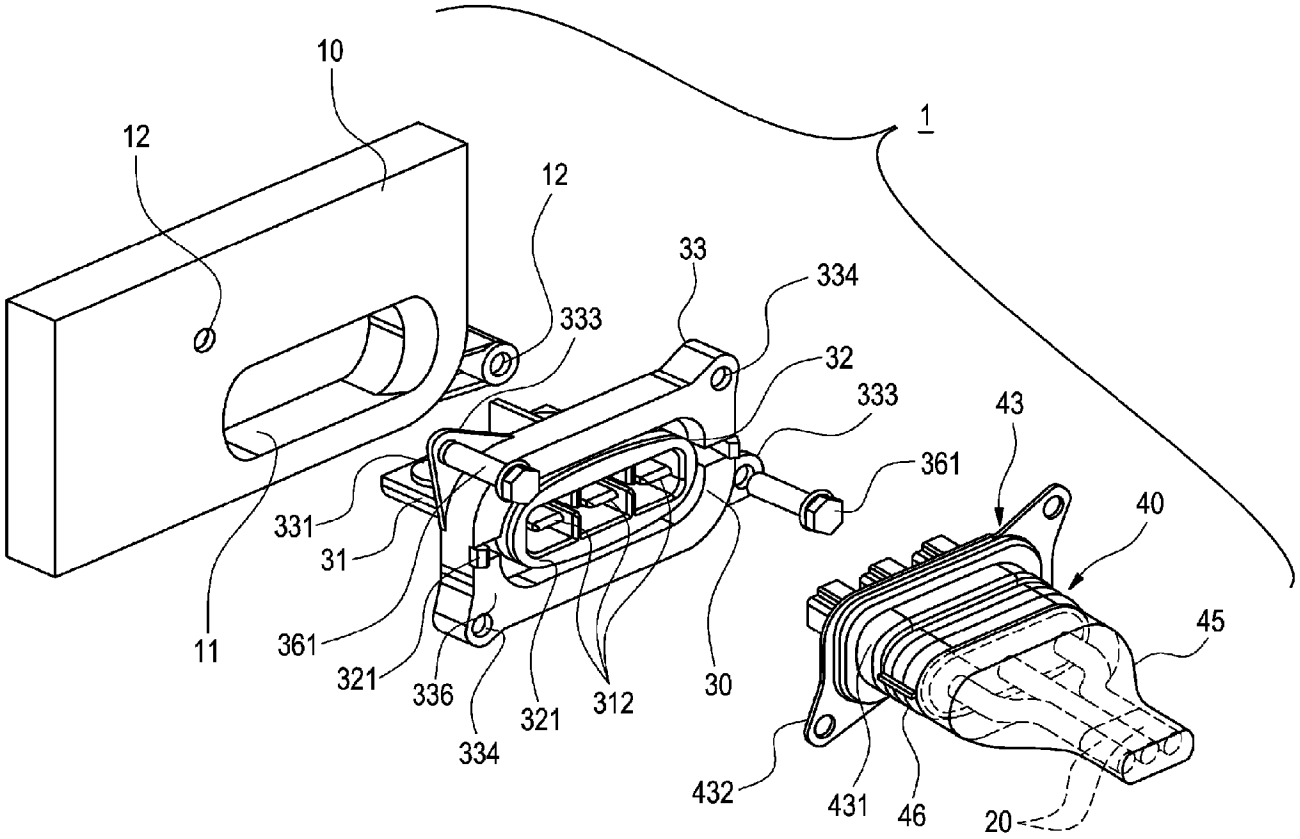
FIG. 1 is an exploded perspective view of the shielded connector of a first embodiment according to the present invention.
Figure 2:
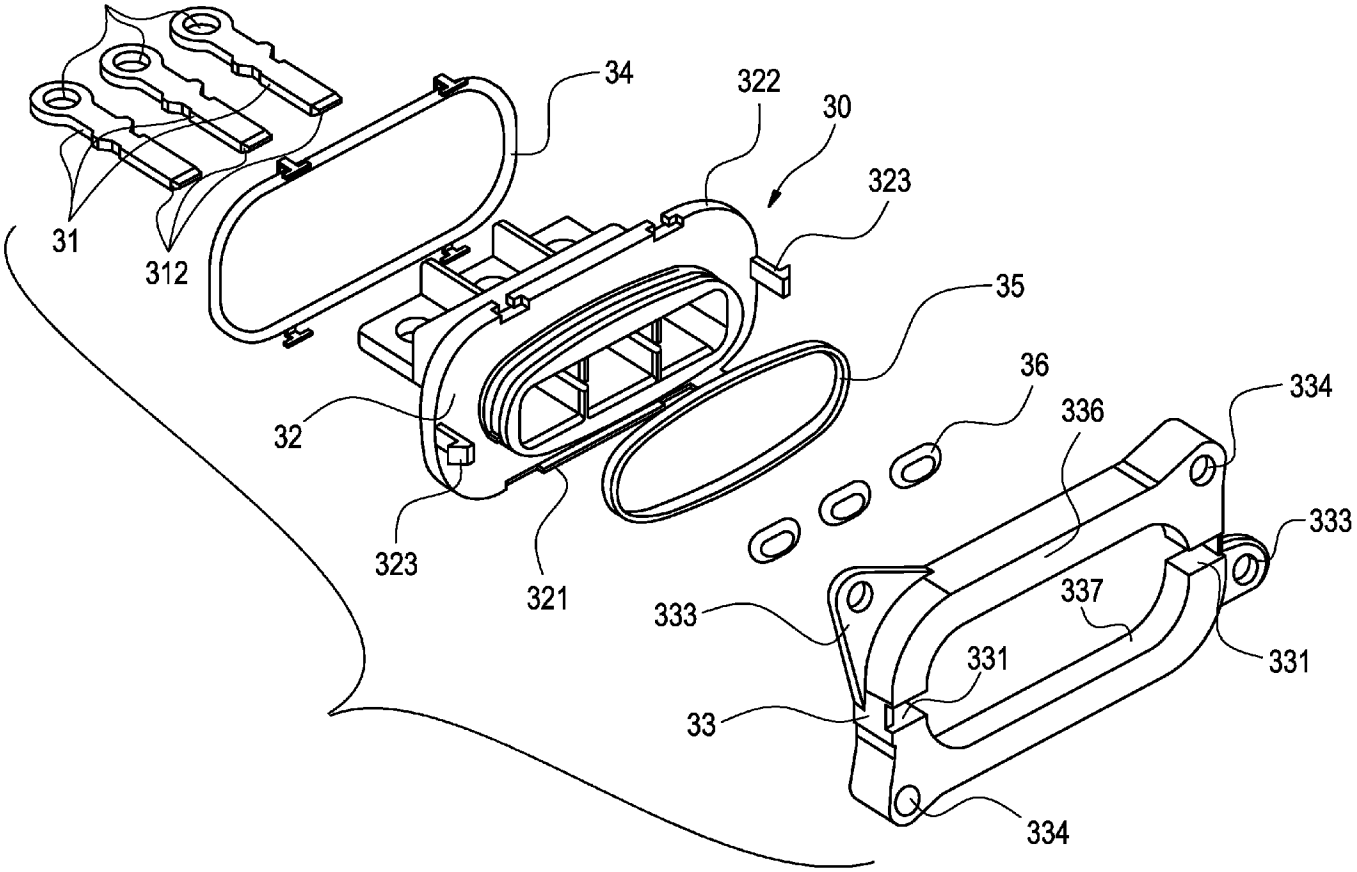
FIG. 2 is an exploded perspective view of a device-side connector shown in FIG. 1.
Figure 3:
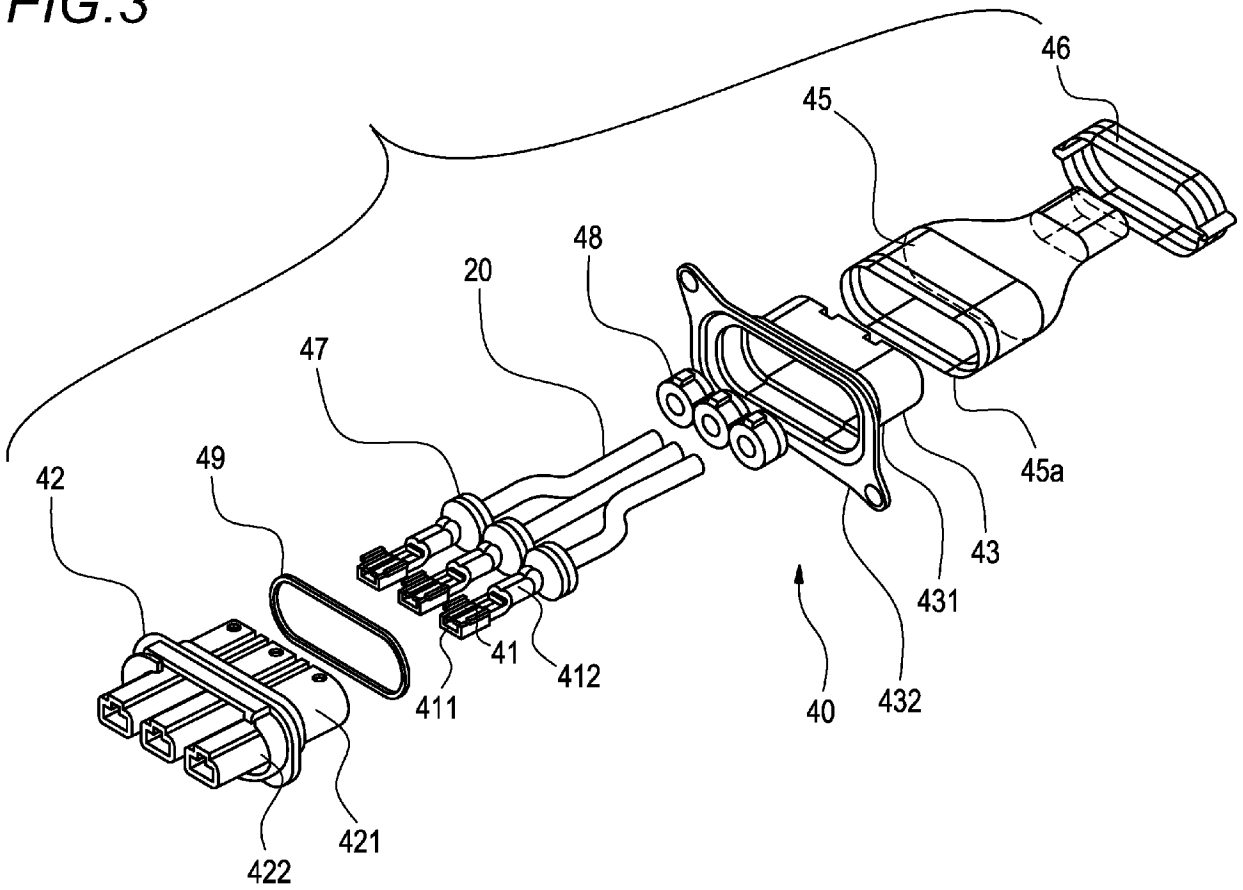
FIG. 3 is an exploded perspective view of a cable-side connector shown in FIG. 1.

As shown in FIGS. 1 to 3, a shielded connector 1 of this embodiment is a connector which connects external cables 20 to a circuit in a shield case 10 of a device carried in an automobile or the like.

The shielded connector 1 of this embodiment includes a device-side connector 30 which is fixed to the shield case 10, and a cable-side connector 40 which is attached to ends of the external cables 20 and is fitted and connected to the device-side connector 30.

The shield case 10 is provided with a connector insertion hole 11 and connector fixing screw holes 12 to attach the device-side connector 30 to the shield case 10. The connector insertion hole 11 is an opening through which a device-side resin housing 32 of the device-side connector 30, to be described below, is inserted. The screw holes 12 are screw holes into which bolts 361 by which a device-side shield shell 33 of the device-side connector 30, to be described below, is fastened are screwed. The screw holes 12 are equipped at two places positioned diagonally at the outer periphery the connector insertion hole 11.

The external cables 20 are electric wires which transmit and receive signals or supply electric power to devices (not shown in the figure) carried in an automobile or the like. A tubular braid 45, which electromagnetically shields the area around the external cables 20, covers the external cables 20 which are connected to the cable-side connector 40.

The device-side connector 30, as shown in FIG. 2, includes device-side connection terminals 31, the device-side resin housing 32, the device-side shield shell 33, a first packing 34, a second packing 35 and terminal sealing rings 36.

The device-side connection terminals 31 which are made of a metal plate include circuit connecting parts 311 at one end and tongue-shaped terminal parts 312 at the other end respectively. The circuit connecting parts 311 are electrically connected to terminals of the circuit in the device (not shown in the figure) by a screw. The tongue-shaped terminal parts 312 are parts to which connection terminals at the side of the cable-side connector 40 is fitted and connected.

The device-side resin housing 32 includes a cylindrical terminal accommodating part 321 which accommodates and holds the device-side connection terminals 31, and a housing flange part 322 which is formed into a flange shape at the periphery of the cylindrical terminal accommodating part 321. The cylindrical terminal accommodating part 321 is set to be smaller than the connector insertion hole 11 to be loosely fitted in the connector insertion hole 11. The housing flange part 322 is set to be larger than the connector insertion hole 11 so that the housing flange part 322 may not be inserted through the connector insertion hole 11.

The device-side resin housing 32 has locking pieces 323 to be coupled with the device-side shield shell 33 to be described below. The device-side resin housing 32 may be fitted and connected to the cable-side connector 40 to be described below when coupled with the device-side shield shell 33.

The device-side shield shell 33 is made of conductive material, and has locking parts 331 to which the locking pieces 323 of the device-side resin housing 32 are locked. When the locking pieces 323 are locked to the locking parts 331, the device-side shield shell 33 holds the device-side resin housing 32 and electromagnetically shields the area around the device-side resin housing 32.

The device-side shield shell 33 further includes case-fixing flange parts 333 which are screw-fixed to the outer surface of the shield case 10 in a face contact state, and mating shell fixing parts 334.

The case-fixing flange parts 333, as shown in FIG. 1, are screw-fixed to the shield case 10 by the bolts 361 which are screwed into the screw holes 12.

The mating shell fixing parts 334 are screw holes by which the cable-side connector 40 is screw-fixed. While the device-side connector 30 is fitted and connected to the cable-side connector 40, the mating shell fixing parts 334 are fastened to a cable-side shield shell 43 (refer to FIG. 3) to be described below which the cable-side connector 40 is equipped with so that the device-side shield shell 33 is conductively coupled with the cable-side shield shell 43.

In this embodiment, the mating shell fixing parts 334 are equipped at a thick part 336 which is positioned at the inner side of the case-fixing flange parts 333.

The thick part 336 is formed to be thick, and protrudes to the outer side of the shield case 10 beyond the projecting height of the bolts 361 which are screw members that connect the case-fixing flange parts 333 and the shield case 10.

Furthermore, a fitting part accommodating hole 337 are formed to penetrate the central part of the thick part 336. The fitting part accommodating hole 337 is a hole which accommodates a cylindrical terminal accommodating part 421 of a cable-side resin housing 42, which is to be described below, of the cable-side connector 40. Since the fitting part accommodating hole 337 is equipped, the thick part 336 functions as a hood part to accommodate a fitting part of the cable-side connector 40.

In this embodiment, the mating shell fixing parts 334 are equipped at the thick part 336. The depth of the screw holes as the mating shell fixing parts 334 is set so that the screw holes do not penetrate the thick part 336.

The first packing 34 is attached to the rear surface of the outer circumferential edge of the housing flange part 322 of the device-side resin housing 32 to face the outer surface of the shield case 10.

The first packing 34 is pressed onto the outer surface (the circumferential part of the connector insertion hole 11) of the shield case 10 when the case-fixing flange parts 333 of the device-side shield shell 33 are screw-fixed to the shield case 10, and seals the space between the device-side connector 30 and the shield case 10.

The second packing 35 is attached to be fitted to the outer periphery of the cylindrical terminal accommodating part 321 at the front surface side of the outer circumferential edge of the housing flange part 322 of the device-side resin housing 32 to face the device-side shield shell 33.

The second packing 35 is clamped between the housing flange part 322 of the device-side resin housing 32 and the device-side shield shell 33, and seals the space between the device-side resin housing 32 and the device-side shield shell 33.

The terminal sealing rings 36 are fitted to the tongue-shaped terminal parts 312 of the device-side connection terminals 31 which are held in the cylindrical terminal accommodating part 321 to prevent water from invading into the shield case 10 along the tongue-shaped terminal parts 312.

Then, the construction of the cable-side connector 40 which is fitted and connected to the device-side connector 30 is described based on FIG. 3.

The cable-side connector 40, as shown in FIG. 3, includes cable-side connection terminals 41, a cable-side resin housing 42 which accommodates and holds the cable-side connection terminals 41, a cable-side shield shell 43 which accommodates and holds the cable-side resin housing 42 and can be screw-fixed to the device-side shield shell 33 of the device-side connector 30, a tubular braid 45 which covers around the external cables 20 which are connected to the cable-side connection terminals 41, a braid fixing ring 46 which fixes the tubular braid 45 to the cable-side shield shell 43, rubber stoppers 47 which are installed to the external cables 20 which are connected to the cable-side connection terminals 41, electric wire holders 48 which are installed to the external cables 20 at the rear side of the rubber stoppers 47, and a third packing 49.

The cable-side connection terminal 41 includes a terminal fitting part 411 which is fitted to the tongue-shaped terminal part 312 of the device-side connection terminal 31 at one end, and includes an electric wire crimping part 412 which are crimped and connected to the external cable 20 at the other end.

The cable-side resin housing 42 includes a cylindrical terminal accommodating part 421 which accommodates the cable-side connection terminals 41, and a housing flange part 422 which is formed into a flange shape at the periphery of the cylindrical terminal accommodating part 421.

The cable-side shield shell 43 includes a cylindrical part 431 which accommodates the rear end part of the cylindrical terminal accommodating part 421 and a connector coupling flange part 432 which is formed into a flange shape at the front end of the cylindrical part 431. The connector coupling flange part 432 abuts against the thick part 336 of the device-side shield shell 33 and is screw-fixed to the mating shell fixing parts 334. When the connector coupling flange part 432 is screw-fixed to the mating shell fixing parts 334, the cable-side connector 40 is coupled with the device-side connector 30.

The tubular braid 45 covers the peripheries of the external cables 20 which extend to the rear side of the cable-side shield shell 43 and electromagnetically shields the area around the external cables 20. A distal end 45*a* of the braid 45 is formed into a cylindrical shape to be externally fitted to the cylindrical part 431 of the cable-side shield shell 43.

The braid fixing ring 46 fastens the tubular braid 45, which is externally fitted to the cylindrical part 431 of the cable-side shield shell 43, to the cylindrical part 431 so that the tubular braid 45 is connected to the shield shell 43.

When the cable-side connection terminals 41 are inserted into terminal accommodation holes formed at the cylindrical terminal accommodating part 421, the rubber stoppers 47 are closely fitted to the terminal accommodation holes to prevent water from invading into the terminal accommodating hole side along the external cables 20.

The electric wire holders 48 are held in the cylindrical part 431 while fitted and installed to the external cables 20, and regulate the displacement of the external cables 20 in the cylindrical part 431.

The third packing 49 is clamped between the housing flange part 422 of the cable-side resin housing 42 and the connector coupling flange part 432 of the cable-side shield shell 43 and seals the space between the cable-side resin housing 42 and the cable-side shield shell 43.

The shielded connector 1 of the first embodiment is described above. The shielded connector 1 includes the device-side connector 30 which is fixed to the shield case 10 and the cable-side connector 40 which is attached to the ends of the external cables 20 and is fitted and connected to the device-side connector 30. Therefore, attaching and detaching the external cables 20 to/from the shield case 10 are realized by attaching and detaching the cable-side connector 40 to/from the device-side connector 30.

In other words, when the external cables 20 are attached to or detached from the shield case 10, the device-side connector 30 may be maintained to be fixed to the shield case 10, and even if the external cables 20 are attached to and detached from the shield case 10 repeatedly, the first packing 34 which seals the space between the device-side connector 30 and the shield case 10 will no be influenced at all.

Therefore, the sealing performance of the part attached to the shield case 10 will not decrease even if the external cables 20 are attached to and detached from the shield case 10 repeatedly.

Besides, for the shielded connector 1 of the first embodiment described above, since the space between the shield case 10 and the device-side connector 30 is sealed by the first packing 34 which is clamped between the case-fixing flange parts 333 of the device-side shield shell 33 and the outer surface of the shield case 10, the device-side resin housing 32 can be loosely fitted in the connector insertion hole 11 at the shield case 10, and the dimension precision of the external shape of the device-side resin housing 32 will not influence the sealing performance of the part attached to the shield case 10.

Therefore, if the dimension of the attached part of the shield case 10 is changed, in response to the change, only the design of the device-side shield shell 33 which is attached to the shield case 10 needs to be changed, but the dimension of the part of the device-side resin housing 32 that is coupled with the shield shell can be maintained as before.

Therefore, when the dimension of the attached part of the shield case 10 is changed, in response to the change, the designs of the components only need to be changed slightly, so that product development in response to the change of the dimension of the attached part of the shield case 10 can be easily performed.

Furthermore, for the shielded connector 1 of the first embodiment described above, since the thick part 336 equipped at the device-side shield shell 33 also serves as the hood part which accommodates the distal end of the cable-side connector 40, it is not necessary to form a hood part, which accommodates the distal end of the cable-side connector 40, at the device-side resin housing 32, so that the construction of the device-side resin housing 32 can be simplified.

Furthermore, since the mating shell fixing parts 334 are equipped at the thick part 336, an enough length (depth) is ensured for the screw holes as the mating shell fixing parts 334 and the connecting strength between the device-side connector 30 and the cable-side connector 40 which are screw-connected can be improved.

FIGS. 4 to 7 show a second embodiment of the device-side connector of the shielded connector according to the present invention.

Figure 4:
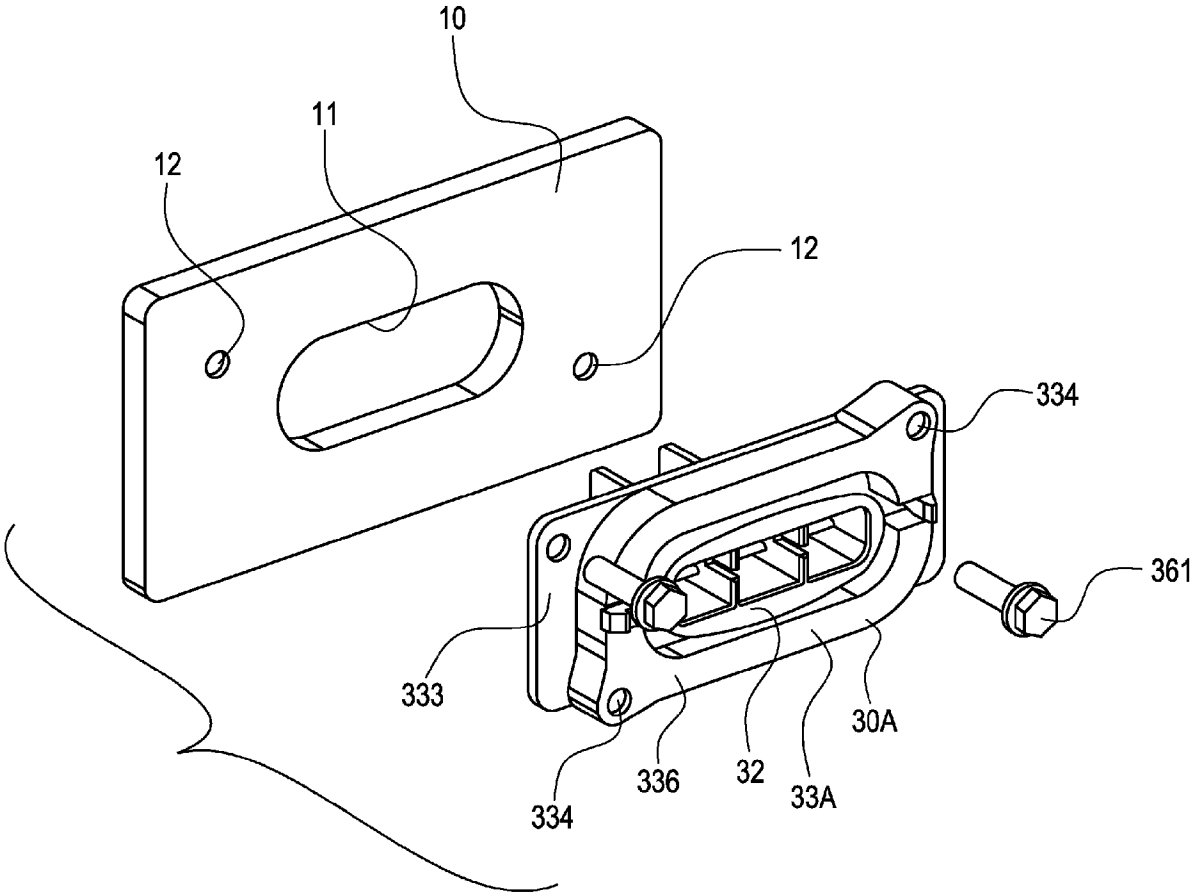
FIG. 4 is a perspective view of the device-side connector of another embodiment according to the present invention.
Figure 5:
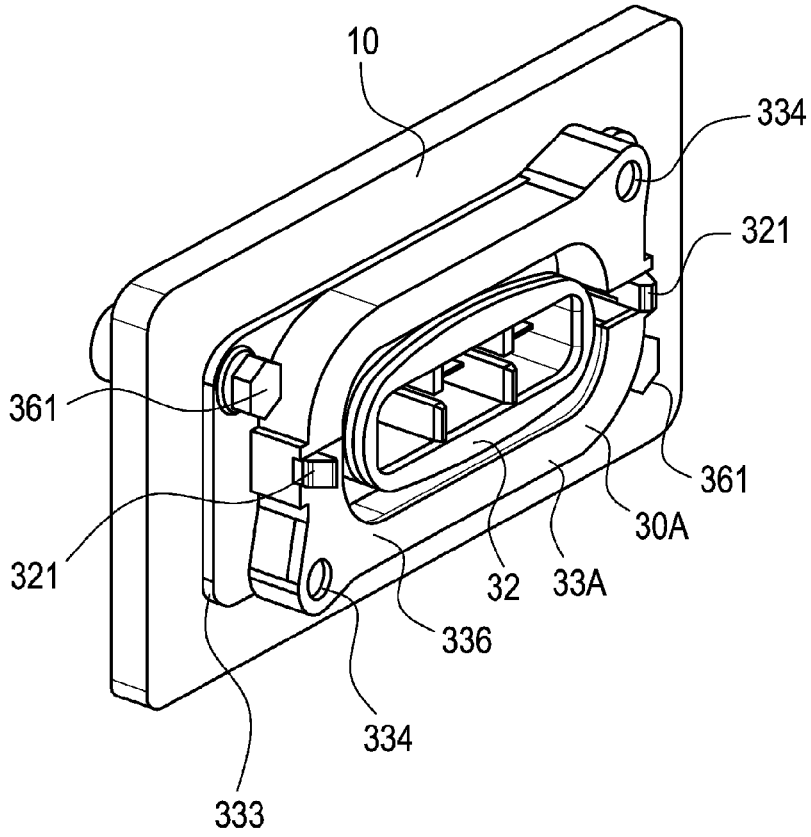
FIG. 5 is a perspective view which shows the device-side connector shown in FIG. 4 is fixed to a shield case.
Figure 6:
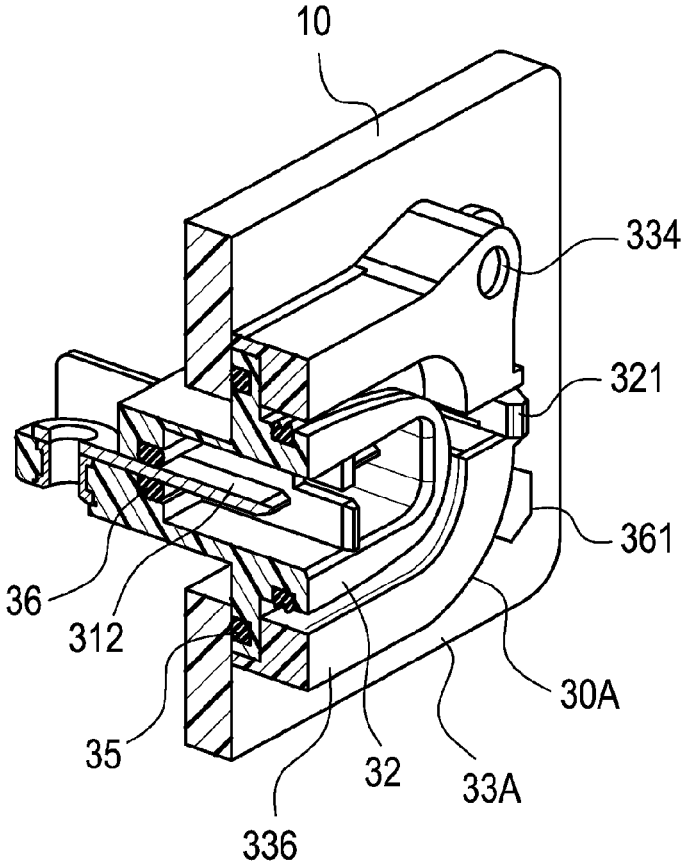
FIG. 6 is a perspective view which shows a section of part of the device-side connector and the shield case shown in FIG. 5.
Figure 7:
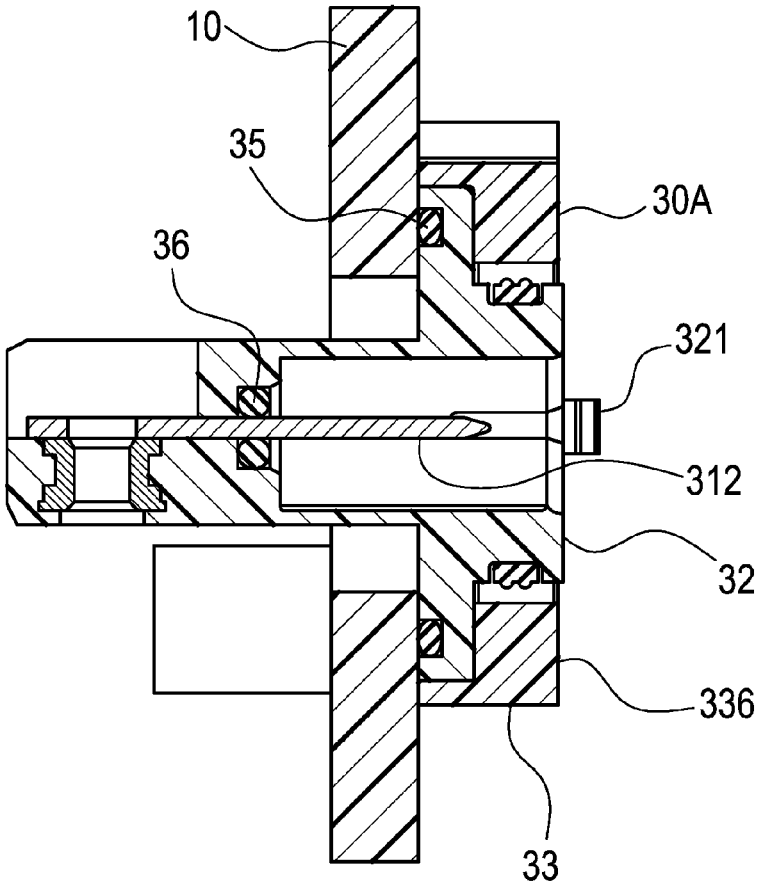
FIG. 7 is a longitudinal sectional view of the device-side connector and the shield case shown in FIG. 5.
Figure 8:
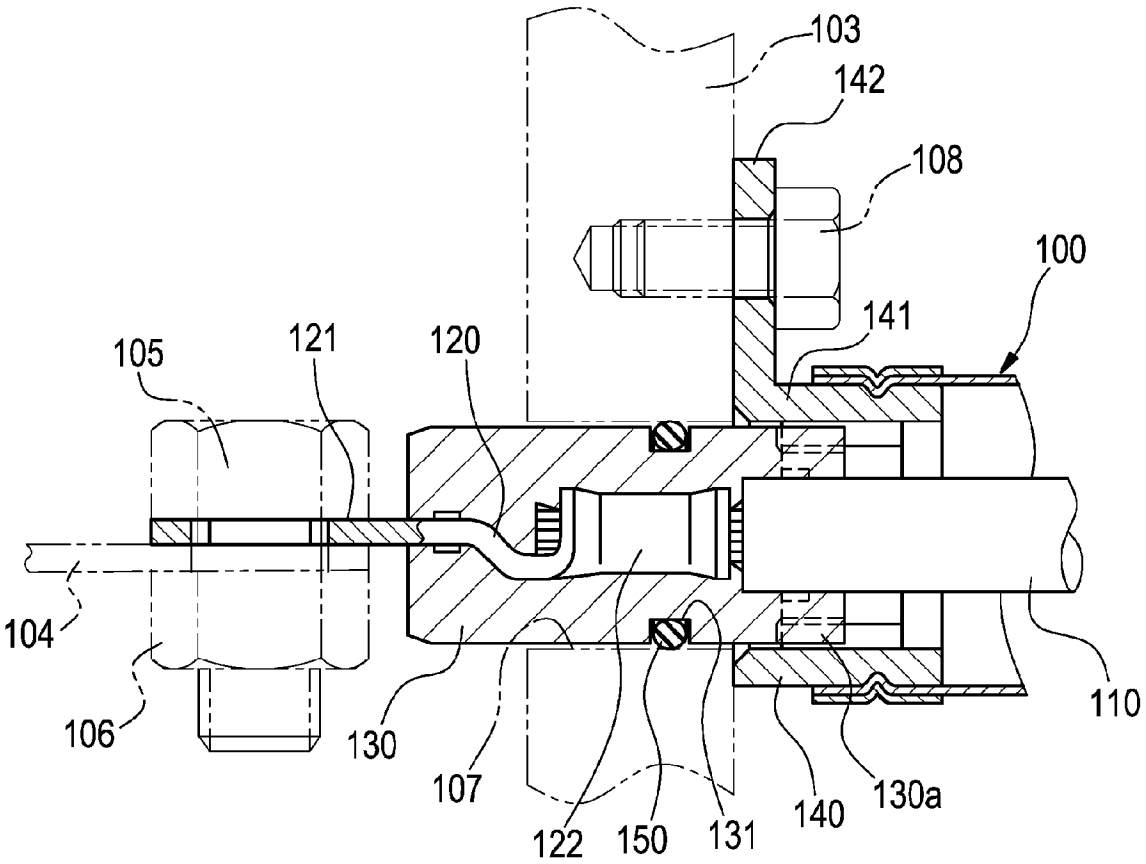
FIG. 8 is a longitudinal sectional view of a traditional shielded connector.

FIG. 4 is a perspective view of the second embodiment of the device-side connector according to the present invention, FIG. 5 is a perspective view which shows that the device-side connector shown in FIG. 4 is fixed to the shield case, FIG. 6 is a perspective view which shows a section of part of the device-side connector and the shield case shown in FIG. 5, and FIG. 7 is a longitudinal sectional view of the device-side connector and the shield case shown in FIG. 5.

A device-side connector 30A of the second embodiment is different from the connector 30 of the first embodiment in that a device-side shield shell 33A, into which part of the device-side shield shell 33 is changed, is adopted instead of the device-side shield shell 33 of the first embodiment.

In the device-side shield shell 33A, the shape of the case-fixing flange parts 333 is changed in response to a change of the arrangement of the screw holes 12 in the shield case 10.

All components of the device-side connector 30A except the device-side shield shell 33A may be the same as those of the first embodiment.

As can be seen from the second embodiment, for the shielded connector of the present invention, when the dimension of the attached part of the shield case 10 is changed, in response to the change, the components only need to be changed slightly, so that product development in response to the change of the dimension of the attached part of the shield case 10 can be easily performed.

The present invention is not restricted to the above-described embodiments, and suitable modifications, improvements and the like can be made. Moreover, the materials, shapes, dimensions, numbers, installation places, and the like of the components in the above embodiments are arbitrarily set as far as the invention can be attained, and not particularly restricted.

According to the shielded connector of the present invention, when the external cables are attached to or detached from the shield case, the device-side connector may be maintained to be fixed to the shield case, and even if the external cables are attached to and detached from the shield case repeatedly, the first packing which seals the space between the device-side connector and the shield case will not be influenced at all.

Therefore, the sealing performance of the part attached to the shield case will not decrease even if the external cables are attached to and detached from the shield case repeatedly.

In addition, if the dimension of the attached part of the shield case side is changed, in response to the change, only the design of the shield shell which is attached to the shield case needs to be changed, but the dimension of the part of the device-side resin housing that is coupled with the shield shell can be maintained as before.

Therefore, when the dimension of the attached part of the shield case side is changed, in response to the change, the designs of the components only need to be changed slightly, so that product development in response to the change of the dimension of the attached part of the shield case can be easily performed.

What is claimed is:

1. A shielded connector which connects an external cable to a circuit in a shield case of a device, the shielded connector comprising:

a device-side connector which is fixed to the shield case; and a cable-side connector which is attached to an end of the external cable and is fitted to the device-side connector, wherein the device-side connector includes:

a device-side connection terminal which has one end connected to the circuit in the shield case and the other end fitted to a connection terminal of the cable-side connector;

a device-side resin housing which accommodates and holds the device-side connection terminal and can be fitted to the cable-side connector;

a device-side shield shell which holds the device-side resin housing and has a case-fixing flange part which is fixed to an outer surface of the shield case by a first screw in a face contact state; and a first packing which is pressed onto the outer surface of the shield case when the case-fixing flange part is fixed to the shield case by the first screw to seal a space between device-side connector and the shield case;

wherein the device-side shield shell has a mating shell fixing part which is fastened to a cable-side shield shell provided on the cable-side connector to electrically connect the device-side shield shell and the cable-side shield shell; and wherein the mating shell fixing part is fastened to the cable-side shield shell by a second screw in a direction being the same as an extending direction of the first screw which fastens the case-fixing flange part to the shield case.

2. The shielded connector according to claim 1, wherein the device-side shield shell has a thick part which is formed in thick shape so as to protrude to an outer side of the shield case beyond the projecting height of the first screw, which fastens the case-fixing flange parts to the shield case, and functions as a hood part to accommodate a fitting part of the cable-side connector; and wherein the mating shell fixing part is provided on the thick part.

* * * * *